US005595010A

United States Patent [19]

Fuller et al.

[11] Patent Number: 5,595,010

[45] Date of Patent: Jan. 21, 1997

[54] SIGN CONSTRUCTION

[76] Inventors: Lionel C. Fuller, 22 Alton Tee, The Gap 4061, Brisbane, Australia; Berin J. Burnett, 72 Ocean Beach Rd., Mt. Maunganui, New Zealand

[21] Appl. No.: 477,199

[22] Filed: Jun. 7, 1995

[30] Foreign Application Priority Data

Aug. 24, 1994 [AU] Australia ..... PM7683

[51] Int. Cl.[6] ..... G09F 15/00

[52] U.S. Cl. ..... 40/606; 40/603; 248/156

[58] Field of Search ..... 40/606, 607, 659, 40/603, 611; 248/156, 440.1, 249, 302, 175

[56] References Cited

U.S. PATENT DOCUMENTS

| | | | |
|---|---|---|---|
| 2,425,036 | 8/1947 | Howe | 248/156 |
| 2,703,890 | 3/1955 | Rinaldy | 248/153 X |
| 3,037,311 | 6/1962 | Ross et al. | 40/603 |
| 3,239,957 | 3/1966 | Snediker | 40/603 X |
| 4,103,445 | 8/1978 | Smith et al. | 40/603 |
| 4,817,319 | 4/1989 | Vitale | 40/610 |
| 4,864,757 | 9/1989 | Lovett | 40/607 |
| 4,866,866 | 9/1989 | Rotter et al. | 40/610 |
| 4,894,937 | 1/1990 | Davis | 40/606 |

*Primary Examiner*—Kenneth J. Dorner
*Assistant Examiner*—Cassandra Davis
*Attorney, Agent, or Firm*—Pearne, Gordon, McCoy & Granger

[57] ABSTRACT

A resilient rod frame for a sign includes side elements for removably supporting a sign display sheet. The side elements extend to spaced lower elements that are received in a rigid keeper. The rigid keeper may be rotated to move the lower elements to an overlying position and thereby cause the side elements to move toward each other to facilitate the mounting and dismounting of the display sheet. The keeper may also be used as a step or pedal to drive spikes formed by terminal rod portions into the ground or other supporting foundation.

10 Claims, 4 Drawing Sheets

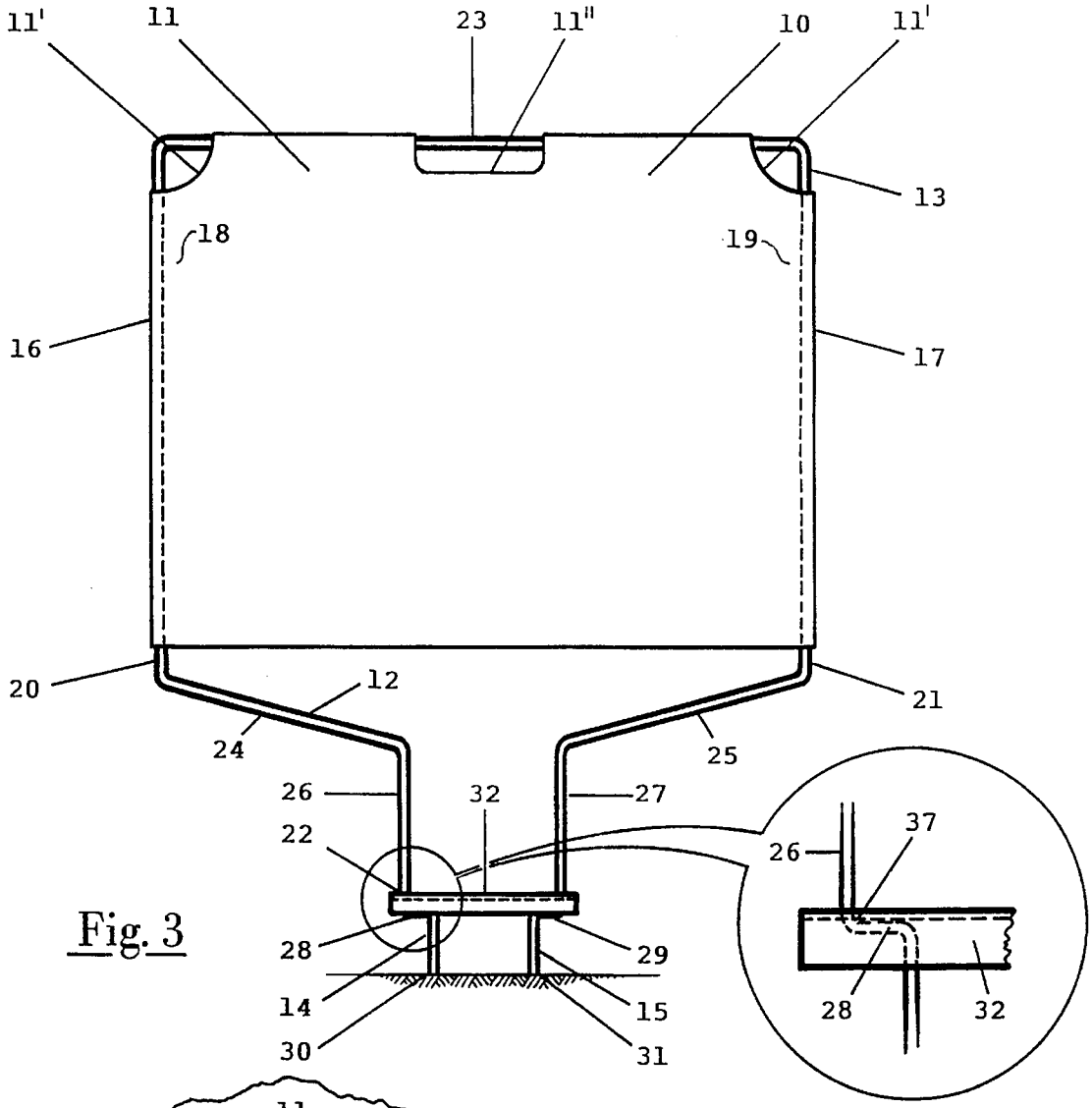
Fig. 3
Fig. 3a
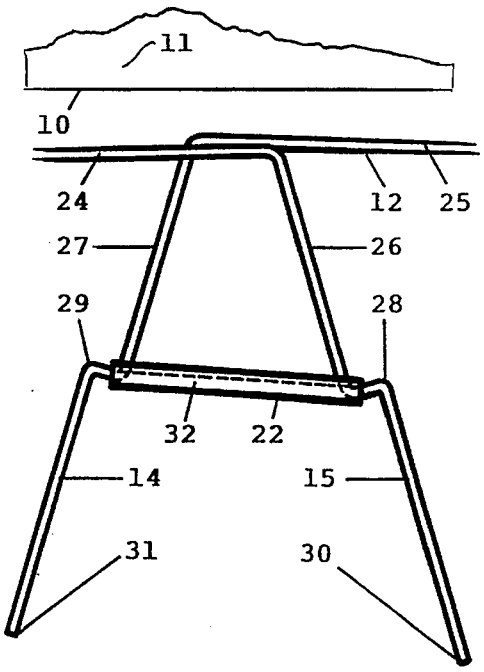
Fig. 4

SIGN CONSTRUCTION

BACKGROUND OF THE INVENTION AND RELATED ART

This invention relates to sign constructions, and it has particular but not exclusive reference to the basic type of sign assembly in which a message-bearing sheet is secured to the upper part of a supporting frame which is adapted to have its lower end secured to the ground or equivalent base means.

In many sign applications, it is required to erect quickly but effectively a sign of simple, inexpensive and useful construction, such as in the real estate industry where it is customary to secure a single sheet of plastic, plywood or other material, such as "CORFLUTE," board, to the upper end of a wooden spike which then has its lower end driven into the ground for example, according to long established systems. It has been found that a number of benefits can be obtained by having the message-bearing sheet secured to the upper part of a supporting frame consisting wholly or principally of strip metal, particularly since the lower extremity will be inherently of spike-like form for easy penetration of the ground. Thus, there are currently available a number of sign assemblies of these types which depart from the conventional but still-common type of sign which may have a sheet of rigid plastic fluted material nailed to the upper part of a wooden stake.

Notwithstanding the aforementioned advancements in sign constructions, it is believed that there remains a need for further improvements, particularly so that the message sheets can be removably and interchangeably fitted with simplicity but certainty without the use of nails, screws or other fasteners. Also, it is desirable that there may be employed a supporting frame which is more easily but firmly erected by ground penetration than has hitherto been achieved, thus making the sign construction attractive to the growing number of real estate agents who prefer to avoid the use of procedures requiring the application of force by hammering. There is also in our view a need for an improved type of message sheet which will be inexpensive yet durable; which can have its messages easily and cheaply applied thereto, and which can be used interchangeably on mounting frames which afford easy assembly or disassembly.

SUMMARY OF THE INVENTION

The present invention has been devised with the above described needs in mind, and it therefore has for its principal object to provide a novel combination of message sheet and mounting frame which will possess the advantageous features set out in the preceding paragraph. Further specific objects and advantages of the invention will become clear from later discussions of the preferred embodiments of the invention.

With these and other objects in view, the invention resides broadly in a sign assembly of the type having a message-bearing display sheet for securement to the upper part of a supporting frame which has ground-penetration spikes at its lower extremity. The display sheet is formed of a flexible material of little or no elasticity and of substantially rectangular form to be disposed vertically in normal use with its side edges each being provided with vertically extending sleeves. The upper part of the supporting frame includes opposite side members engageable in the sleeves. The supporting frame also includes a clamping device selectively operable between a release position and a clamping position. In the latter position, the side members are urged apart to cause them to grip within the sleeves and tension the display sheet and to fix the frame members against relative movement in a generally planar configuration.

The display sheet, supporting frame, spikes and clamping device may take various forms within the broad concepts of the invention. For example, the display sheet may be of single sheet thickness between closed-edge sleeves at each side, particularly if the frame side members are not connected at their upper ends or are releasably interconnected by a top bar formed of separable components. On the other hand, the display sheet may be double thickness in the form of an envelope having its edges accommodating the frame side members. The latter can if desired be connected at their upper ends, in which case the envelope need be open only at its bottom. Then again, the upper edge of the envelope may be closed but provided with cut-out sections to expose the top bar when the latter is provided, and thus affording a handle in that case.

The supporting frame may have rigid bars for the side members, moveable to clamping dispositions by a cam or cams constituting the clamping device. However, it is preferred that the side members be of resilient rod-like form and interconnected at their upper ends by an integral cross rod. In that event, the clamping device may comprise a horizontal keeper arranged to be moved to an operative attitude to urge the side rods apart, or to be moved to a release disposition to permit removal of the display sheet.

Thus, according to one practical embodiment of the invention it may comprise broadly a sign assembly of the type having a message-bearing display sheet secured to the upper part of a supporting frame. The frame has at least one ground penetration spike at its lower extremity. The display sheet is formed of flexible, but substantially inelastic, material and has a generally rectangular form. The display sheet is adapted to be disposed vertically in normal use with spaced vertical side edges, each having a sleeve extending therealong, for mounting to the supporting frame. The supporting frame includes resilient opposite vertical side bars adapted to be engaged in associated sleeves of the display sheet and to be urged apart to hold the inelastic display sheet in taut or tensioned operative attitude. The upper ends of the side bars are connected by a top frame member for predetermined separation, and the lower ends of the side bars are constructed and arranged so that each has its lower extremity forming a ground-penetration spike. The two lower ends of the side bars are connected by a clamping device or releasable securement in such a manner that they may be moved apart to operative positions to cause tensioning of the display sheet and assume ground-penetration attitudes, or they may be rendered inoperative when the mounting frame is clear of the ground to permit the lower ends of the side bars to be moved to inoperative positions to release tension of the display sheet to facilitate the removal thereof.

In accordance with a preferred embodiment of the invention, the supporting frame is a continuous length of spring steel rod having an upwardly-bowed top rod integral with normally parallel and vertical side rods constituting the said side bars, each of the latter having an inwardly-returned bottom bar so that the aforementioned components can make up a rectangular frame portion to be fitted within a message-display sheet assembly in the form of an envelope open at its bottom only. The envelope-type sheet assembly is suitably made of a flexible but inelastic material which is a printable fabric, waterproof, tear-resistant and opaque to allow for printing on both outer sides, such as high quality plastic wrapping material for industrial use.

In this instance, the supporting frame is inserted through the open "bottom" of the envelope, the double thickness of the latter providing a "sleeve" at each side edge to be engaged by the side bars or rods, and the top of the envelope can be closed fully since the top rod of the frame is integral with the side rods. It will be appreciated that flexing of the lower ends of the side rods towards one another will cause an increase in bowing of the curved top rod to reduce the width of the frame and thus facilitate its insertion into the "envelope". On the other hand, separation of the lower ends of the side rods will cause them to engage firmly in their sleeves and bring the frame to a firm rectangular fit within the envelope.

In this embodiment, when the side rods are in vertical, substantially parallel operative positions, the return bars at the lower ends terminate a distance apart where they have integral down-turned rod sections, the lower ends of which are connected through horizontally stepped formations to the terminal spike end portions. The clamping device or releasable securement comprises a keeper bar of such length as to accommodate the width of a user's shoe thereon and having vertical apertures near its ends through which the down-turned rod sections pass. If the clamping device or keeper is subsequently assembled onto the rods, the apertures may connect with longitudinal end slots which are longitudinally elongated to accommodate the stepped formations when the latter are arranged to extend either inward or outward according to whether the keeper is separating the frame ends for operative actions or allowing them to "overlap" for inoperative actions.

The keeper is suitably of inverted channel section having at each end a slotted hole in its top web through which the spaced rods pass rotatably to permit turning of the keeper in reversed end-to-end manner between operative and inoperative dispositions, the keeper being shaped to assist manual gripping of its lower edge for lifting purposes by hand when so desired, to effect unclamping. The rods may be tapered or vertical as desired to assist the clamping actions, the slotted holes and keeper acting to stop the rods from going inward or outward to tension or slacken the sign. Other features of the invention will become apparent from the following descriptions.

BRIEF DESCRIPTION OF THE DRAWINGS

In order that the invention may be more readily understood and put into practical effect, reference will now be made to the accompanying drawings which show several embodiments of the invention, given by way of example only, and wherein:

FIG. 3 shows the assembled sign according to the invention, in operative attitude, with the display sheet held on the supporting frame which is secured in the ground;

FIG. 3*a* is a diagrammatic fragmentary view showing on an enlarged scale the indicated portion of FIG. 3;

FIG. 4 shows in enlarged view the lower components of the supporting frame, when removed from the ground, and with components in fully-released attitudes;

DETAILED DESCRIPTION OF THE DRAWINGS

Figure 2:
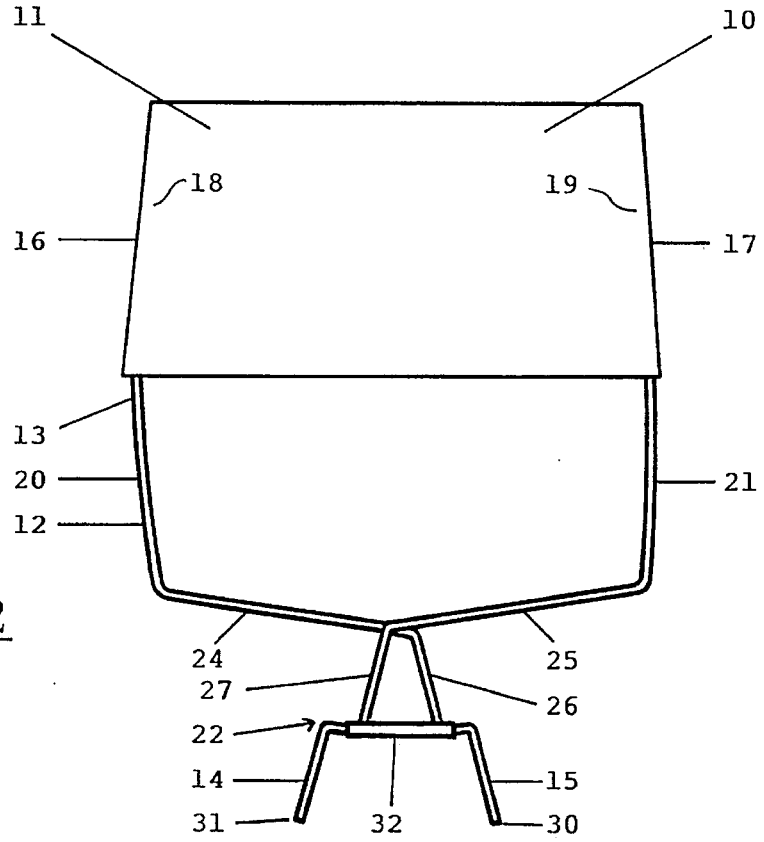
FIG. 2 shows the frame of FIG. 1, together with a display sheet in the form of an envelope, open at the bottom, in the process of being attached over the frame.
Figure 1:
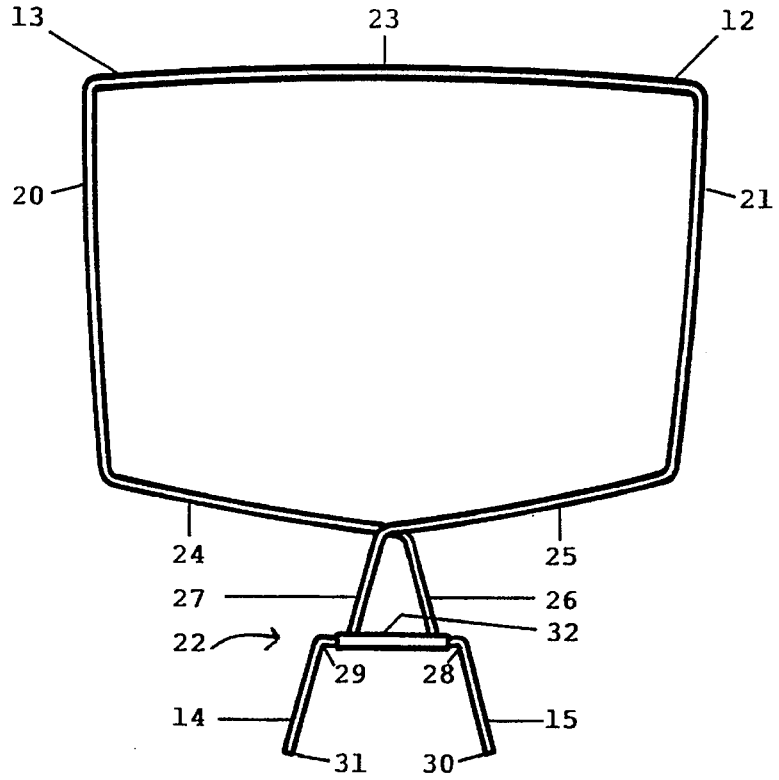
FIG. 1 shows the frame for a sign assembly according to the invention, in inoperative attitude, ready to receive the display sheet, and the frame being of spring steel rod.

Referring to FIGS. 1–4, the sign assembly shown generally by the numeral 10 includes a message bearing display sheet 11 in the form of an envelope as previously described, of double thickness or bag type configuration so that the side edges constitute sleeve means. The display sheet 11 is to be mounted on a supporting frame indicated generally at 12, the frame having an upper part 13, while ground-penetration spikes indicated generally at 14 are provided at the lower end 15 of the frame 12. The side edges 16 and 17 of the display sheet 11 respectively provide sleeves 18 and 19. It will be seen that the frame 12 includes side members 20 and 21 which are engageable in the respective sleeves 18 and 19, while a clamping device, indicated generally at 22 can be utilized to hold the display sheet 11 on the frame 12 as shown in FIG. 3, or to release the components as shown in FIGS. 1, 2 and 4.

The display sheet 11 may suitably measure about 600 mm wide and 450 mm high, with the other components of the frame 12 being to corresponding proportions. The display sheet 11 may include corner cut-outs 11' to facilitate alignment at the frame corners and a central cut-out 11" that exposes a portion of the frame for use as a handle.

It will be seen that the frame 12 consists of a single continuous length of spring steel of 6 mm diameter and having an integral top rod 23 and two side rods which constitute the side members 20 and 21 which when operative are vertical in the respective sleeves 18 and 19. The lower ends of the side rods 20 and 21 have integral inturned sections 24 and 25 respectively, with down-turned sections 26 and 27 leading through horizontally stepped portions or formations 28 and 29 to terminal spikes 30 and 31 for mounting to a foundation.

There is provided a bridge piece or keeper bar 32 constituting part of the clamping device 22 and being long enough to allow a person's shoe to press it down, there being vertical apertures near its ends to accommodate the stepped formations, whether extended in the direction shown in FIG. 3 or with the keeper reversed so that the frame ends overlap as shown in FIGS. 1, 2 and 4.

The unique features of the sign will be clear from the drawings, when considered in conjunction with the foregoing descriptions. FIG. 3 shows the operative disposition wherein the bottom frame ends are separated to the extent necessary to maintain the display sheet 11 tensioned, whereupon the keeper 32 can be pressed down by the foot and the stepped formations will be held in the end apertures and groove of the keeper as the bottom extremities are pressed into the ground and the complete sign becomes rigid. However, when the sign assembly 10 is lifted from the ground, the keeper 32 can be lifted to "unlock" the frame ends which can then be moved to overlapping relationship as shown in FIGS. 1, 2 and 4 the keeper being rotatable to reverse its attitude end to end as apparent from the drawings.

Sign assemblies as described and illustrated will be seen to provide all the principal advantages as discussed above. The flexible display sheet will be retained neatly over the outside of the spring loaded frame. The bridge piece or keeper 32 may be used to turn the bottom rods to attitudes or orientations permitting ease of entry and removal of the display sheet from the frame, and the keeper 32 enables the user to tread the sign into the ground or to lift the sign out of the ground. The keeper may be color coded to identify the sign frame, thus making it an integral part of the frame to deter theft and so that it cannot be removed without damage to the frame.

Figure 5:
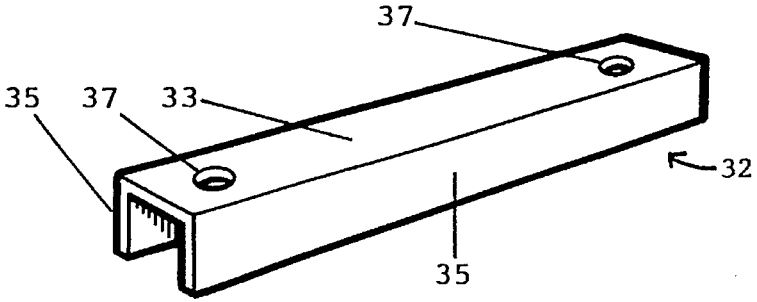
FIG. 5 is a perspective view of a clamping device or keeper.

A simple locking action results from the keeper being of inverted channel cross-section and arranged to restrain the legs of the frame so that it may be easily inserted into the ground, and the frame will be prevented from turning clockwise or counter-clockwise when viewed from above. As best shown in FIG. 5, the keeper 32 comprises a generally U-shape or channel-shape rigid member including a bight 33 and opposed legs 35. Apertures 37 extend through the bight 33 to receive the lower ends of the side rods 20 and 21. The locking action is provided by the receipt of the stepped portions 28 and 29 within the channel between the legs 35 of the keeper 32.

Figure 7:
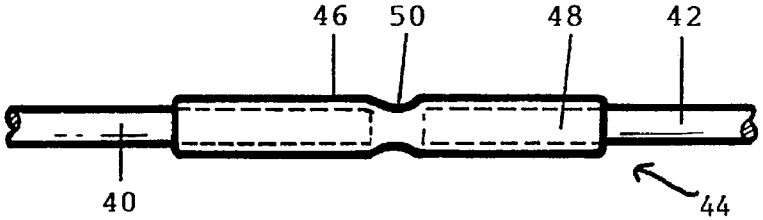
FIG. 7 is a fragmentary view, partly in section and on an enlarged scale, corresponding with the area designated "A" in FIG. 6*a* and showing the removable connection in the top bar of the frame of the second embodiment of the invention.

Referring to FIGS. 6 and 7, a second embodiment of the frame of the present invention is illustrated. For convenience, similar reference numerals are used to designate parts which correspond to similar parts in the first embodiment. However, the letter "a" will be added to the reference numerals to indicate modified elements of the second embodiment of FIGS. 6 and 7.

The sign 10*a* includes a supporting frame 12*a* formed of wire rod stock such as that described in connection with the first embodiment. The frame 12*a* comprises symmetrical frame halves 40 and 42. The frame halves 40 and 42 are joined adjacent the top rod 23*a* by a connector 44 with each side member 20 and 21 extending to form about one-half of the top rod 23*a*.

As best shown in FIG. 7, the connector 44 comprises a rigid metal tube 46 having a bore 48 sized to receive with hand assembly the rod stock of the frame 12*a*. The connector 44 is pinched at a central longitudinal location to provide a reduced diameter bore stop 50 that limits the insertion of the rod stock of the frame halves 40 and 42 into the bore 48 to assure the proper assembly configuration.

As noted above, the frame halves 40 and 42 may be assembled by hand using the connector 44. Upon assembly, the frame halves 40 and 42 cooperate to provide a construction similar to that of the first embodiment. Accordingly, the assembled frame 12*a* includes upper part 13 and lower part 15. The upper part 13 includes side members 20 and 21 which cooperate to receive and mount the display sheet 11 in the same manner as in the first embodiment. In this embodiment, the top rod 23*a* is formed by the extensions of the side members 20 and 21 joined by the connector 44.

The side members 20 and 21 of the frame 12*a* include inturned sections 24 and 25 which extend to down-turned sections 26*a* and 27*a*. As shown, the sections 26*a* and 27*a* preferably diverge outwardly at a slight angle from the stepped portions 28 and 29 to inhibit unintentional upward movement of the keeper 32 which may tend to occur in buffeting wind conditions. An opening angle of 6 to 7 degrees from the vertical or an outward pitch of about ⅙ is satisfactory for this purpose.

Figure 6C:
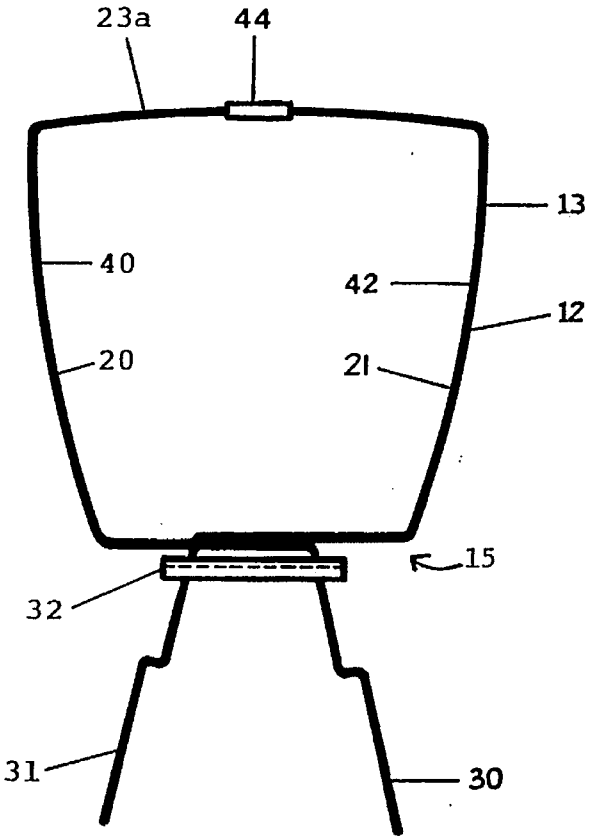
FIG. 6*c* is a diagrammatic view similar to FIG. 6*a* showing the keeper rotated about 180° in a right-hand direction to reduce the width dimension of the frame and dispose it in a display sheet loading condition.
Figure 6B:
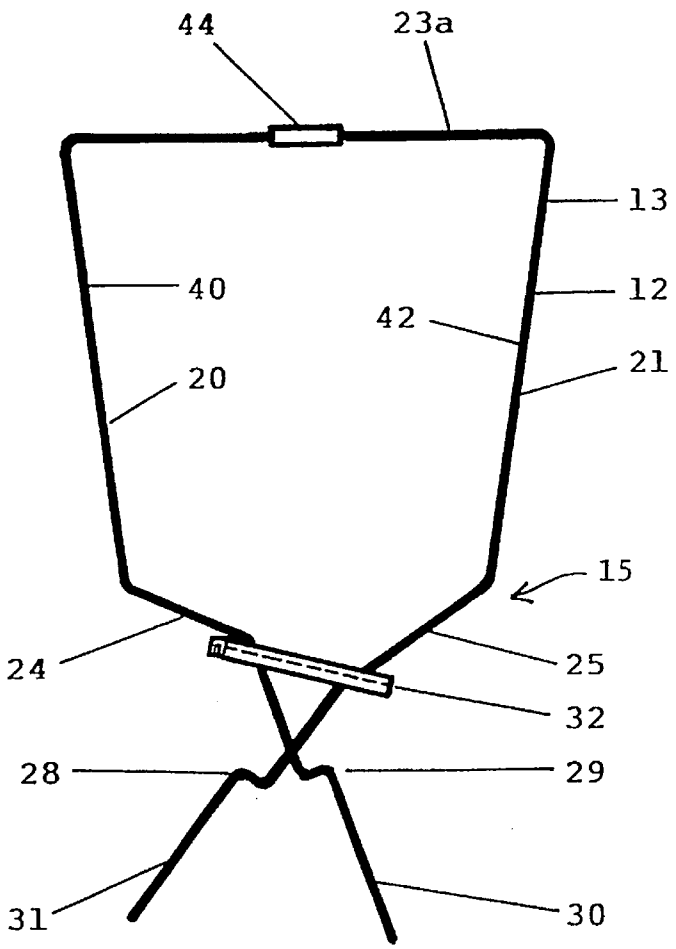
FIG. 6*b* is a diagrammatic view similar to FIG. 6*a* showing the keeper rotated about 75° in a right-hand direction.
Figure 6A:
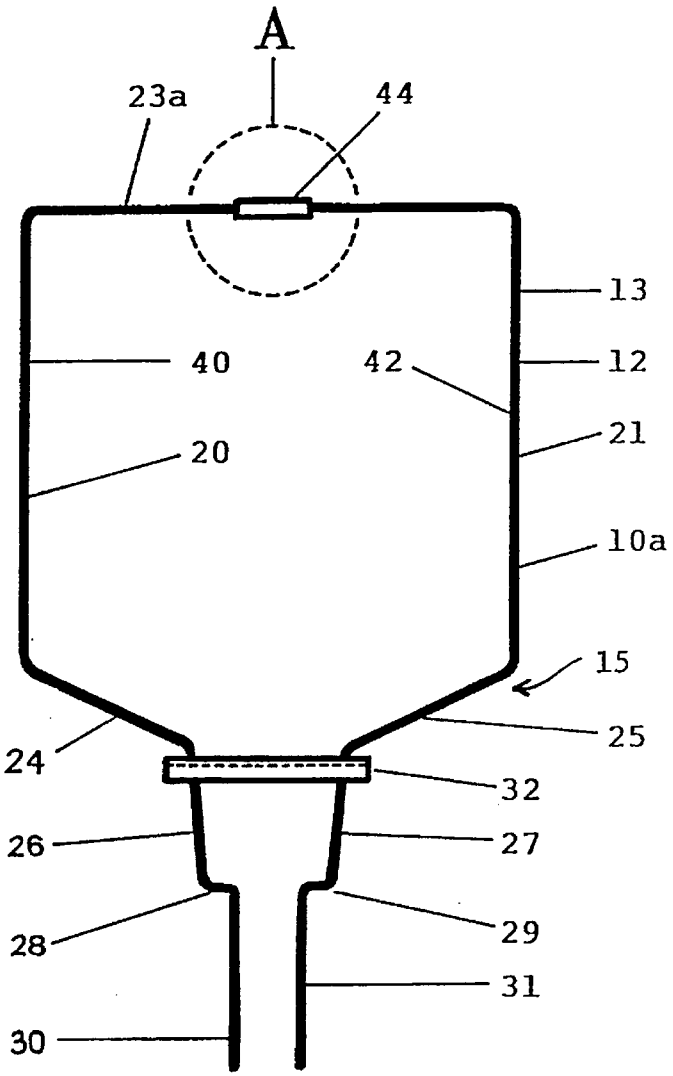
FIG. 6*a* is a diagrammatic view of a second embodiment of a frame in a relaxed condition with the keeper moved to an upper display sheet loading condition in accordance with the invention.

The preparation of the frame 12*a* for the mounting thereon of the display sheet 11 is shown in FIGS. 6*a*, 6*b* and 6*c*. As shown in FIG. 6*a*, the keeper 32 is initially moved up the down-turned sections 26*a* and 27*a* of the lower part 15 to disengage the horizontal stepped portions 28 and 29.

In preparation for moving the inturned sections 24 and 25 into overlying position, the top rod 23*a* of the frame 12*a* may be gripped with the left hand. The opposite sides of the keeper 32 may be gripped from the bottom using the right hand thumb to engage one of the sides of the keeper and the fingers to engage the other side of the keeper in a "key-winding" type grip that allows the right hand to twist or rotate the keeper to the right.

As shown in FIG. 6*b*, the keeper 32 has been turned about 75° to the right and the top rod 23*a* has been held rotationally stationary (or retained in the plane of the drawing page) by the left hand. It should be appreciated that the inturned sections 24 and 25 are free to rotate within the apertures in the keeper 32 as the keeper is rotated, and the keeper operates to laterally move the sections without twisting or applying a torque load to the wire rod of the frame 12*a*.

Referring to FIG. 6*b*, the inturned sections 24 and 25 have been moved inwardly to reduce the width of the spacing between the side members 20 and 21. The lateral spacing of the side members 20 and 21 or width of the upper part 13 of the frame 12*a* progressively decreases in a direction extending towards the lower end 15 of the frame 12*a* with slight outward bowing or deflection of the side members and top rod 23*a*. The connector 44 is sized to accommodate this deflection.

Referring to FIG. 6*c*, the frame 12*a* is shown in the display sheet loading or mounting condition with the keeper 23 rotated 180° to the right and the inturned sections 24 and 25 moved to their full overlying position. As the keeper 32 is moved to this position, the overlying portions of the inturned sections 24 and 25 may also be grasped within the right hand together with the keeper 32. In this manner, the frame 12*a* is fully supported in the display sheet mounting condition by the user's right hand, and the user's left hand is free to slip the display sheet 11 over the upper part 13 of the frame 12*a*. In the display sheet mounting condition shown in FIG. 6*c*, the lateral spacing of the side members 20 and 21 and the width of the frame 12*a* are reduced fully, and the display sheet 11 may be easily slipped over the upper part 13 of the frame 12*a*.

After the display sheet 11 has been mounted on the upper part 13 of the frame 12*a*, the keeper 32 is rotated to the left or returned to its starting position and the frame 12*a* resiliently moves to its normal position wherein the display sheet 11 is held in tension in a planar condition between the side members 20 and 21. The keeper 32 is then moved to its lower or locking position with the horizontally stepped portions 28 and 29 disposed within the keeper channel. As noted above, the keeper 32 may be used as a step or pedal to drive the spikes 30 and 31 into the ground or other foundation for purposes of mounting the sign 10*a*.

The frame 12*a* and the connector 44 is constructed to enable the sign 10*a* to be collapsed for storage or transportation. The display sheet 11 may be removed from the frame 12*a* using the above discussed technique to reduce the width of the upper part 13 of the frame. After removal of the display sheet 11, the frame halves 40 and 42 may be disconnected at the connector 44. One of the horizontally stepped portions, e.g. the portion 29 of the frame half 42, may be moved clear of the keeper 32 and the frame half 42 may then be rotated onto the frame half 40 to reduce the collapsed sign width by about one-half. Also, the cut-out 11" in the display sheet 11 may be used to provide access to the connector 44 to enable the frame halves to be separated without removing the display sheet from its mounted position over the upper-part 13 of the frame 12*a*.

It will be appreciated that the frame could be molded from plastics or fiberglass, and while it is preferably made of resilient steel, it could even be made from bent cane. The sign itself could be laminate fabric, a film rubber, or of any material having the desired characteristics for little or no stretch or elasticity, and being printable for sign purposes. The frame could also be made in two pieces by joining it at the top with a simple tube strong enough to take the bending upwards, thus also acting as a handle. It will be clear that the sign may be made simply without he necessity for nails, screws or other fittings to connect the display sheet to the frame, and without the need for any hammering since the user's foot may press the sign into position. The sign avoids the danger of splinters common with rough wooden stakes, and the total cost will be much less than for rigid signs.

The display sheets are interchangeable quickly and easily on site so that different messages can be provided as required. The display sheet can be rolled up for storage purposes, thus requiring less space in the trunk of an automobile or in a store room. The user will find it convenient to have to deal solely with two components with minimum effort and ease of assembly within a few seconds. The signs will last longer since they will not be subject to damage, and the use of metal spikes will avoid damage to footpaths or lawns since they do not leave large holes. The signs will be found lighter and easier to carry and handle compared with conventional stake signs, and the dimensions can be kept small when inoperative, an advantage where space is limited for storage purposes.

It will be understood that the invention may be subject to even further modifications, as will be apparent to persons skilled in the art, without departing from the broad scope and ambit of the invention, the general nature of which has been herein set out.

What is claimed:

1. A frame assembly for removably supporting a display sheet to form a sign adapted to be secured to a foundation during use thereof, said frame assembly having a width and comprising resilient rod means including sign supporting side elements extending to lower support elements spaced apart in the direction of the width of said sign, clamping means including a rigid member having a length and apertures at spaced locations along its length for receiving said lower support elements, said rigid member being operable to move said lower support elements between release and clamping positions for respectively mounting and dismounting the display sheet between said side elements and for retaining the display sheet in a substantially planar orientation between said side elements during use of the sign, said rigid member being operable to dispose at least a portion of said lower elements in overlying relationship in said release position to resiliently bias said side elements toward each other a sufficient amount to facilitate the mounting and dismounting of said display sheet, said rigid member being adapted to cooperate with the frame assembly in said clamping position to retain said side elements in spaced apart relationship with said display sheet extending therebetween in a tensioned condition and to inhibit relative movement of said side elements.

2. The frame assembly of claim 1, wherein said clamping means also provide a working surface for applying a load to said frame assembly to secure it to said foundation.

3. The frame assembly of claim 1, wherein each of said lower elements includes an angularly offset portion, and said rigid member receives said angularly offset portions in said clamping position to retain said side elements in spaced apart relationship with said display sheet extending therebetween in a tensioned condition.

4. The frame assembly of claim 3, wherein said resilient rod means include at least one resident rod forming a rectangular shape including said side elements for mounting said display sheet, said lower elements include inturned sections of said side elements that extend to down-turned portions having said angularly offset portions, said offset portions extending to spike portions adapted to be inserted in said foundation, and said rigid member comprises a channel-shape member having opposed channel legs connected by a bight having said apertures therein, said apertures receiving said down-turned portions during operation of said lower elements to said release position, said channel legs receiving said offset portions therebetween upon operation of said frame assembly to said clamping position.

5. The frame assembly of claim 4, wherein said resilient rod means include a second resilient rod member, said first and second rod members being symmetrically shaped and connectable to temporarily form said frame assembly.

6. A sign assembly comprising a display sheet removably mountable on a frame adapted to be secured to a foundation for supporting said sign assembly during use thereof, said frame having a width and comprising resilient rod means including sign supporting side elements extending to lower support elements spaced apart in the direction of the width of said sign, clamping means including a rigid member having a length and apertures at spaced locations along its length for receiving said lower support elements, said rigid member being operable to move said lower support elements between release and clamping positions respectively for mounting and dismounting the display sheet between said side elements and for retaining the display sheet in a substantially planar orientation between said side elements during use of the sign assembly, said rigid member being operable to dispose at least a portion of said lower elements in overlying relationship in said release position to resiliently bias said side elements toward each other a sufficient amount to facilitate the mounting and dismounting of said display sheet, said rigid member being adapted to cooperate with the frame in said clamping position to retain said side elements in spaced apart relationship with said display sheet extending therebetween in a tensioned condition.

7. The sign assembly of claim 6, wherein said clamping means also provide a working surface for applying a load to said frame to secure it to said foundation.

8. The sign assembly of claim 6, wherein each of said lower elements includes an angularly offset portion, and said rigid member receives said angularly offset portions in said clamping position to retain said side elements in spaced apart relationship with said display sheet extending therebetween in a tensioned condition.

9. The sign assembly of claim 8, wherein said rigid member has a channel shape having opposed channel legs, connected by a bight having said apertures therein, said apertures receiving said lower elements during operation of said lower elements to said release position, said channel legs receiving said offset portions therebetween upon operation of said frame to said clamping position.

10. The sign assembly of claim 8, wherein said resilient rod means comprises a resilient metal rod.

* * * * *